US006341551B1

(12) United States Patent
Comeyne

(10) Patent No.: US 6,341,551 B1
(45) Date of Patent: Jan. 29, 2002

(54) LAND MINE HUNTER KILLER TECHNIQUE

(76) Inventor: William G. Comeyne, 15917 Moncure Dr., Montclair, VA (US) 22026-1350

( * ) Notice: Subject to any disclaimer, the term of this patent is extended or adjusted under 35 U.S.C. 154(b) by 0 days.

(21) Appl. No.: 09/791,601

(22) Filed: Feb. 26, 2001

(51) Int. Cl.[7] ..... B64D 1/04
(52) U.S. Cl. ..... 89/1.13; 89/1.11; 86/50
(58) Field of Search ..... 89/1.13, 1.11; 86/50

(56) References Cited

U.S. PATENT DOCUMENTS 5,831,724 A * 11/1998 Cordes ..... 89/1.13
5,936,185 A * 8/1999 Tokuni ..... 89/1.13
5,988,038 A * 11/1999 Feintuch ..... 89/1.13
6,155,155 A * 12/2000 Moshier ..... 89/1.13

* cited by examiner

*Primary Examiner*—J. Woodrow Eldred
(74) *Attorney, Agent, or Firm*—Milton W. Lee; John E. Holford

(57) ABSTRACT

A technique for integrating detection and neutralization of land mines that can be used for both mine breaching and mine clearing. A land mine is sensed with multiple sensors to determine a mine signature with corresponding range and azimuth. Mine type and mine emplacement which correlates to the mine signature is determined, and a neutralizer type and configuration is determined which correlates to the mine type. A neutralizing magazine is selected for the neutralizer type and configuration. The selected neutralizer is configured, loaded, launched, and armed.

3 Claims, 1 Drawing Sheet

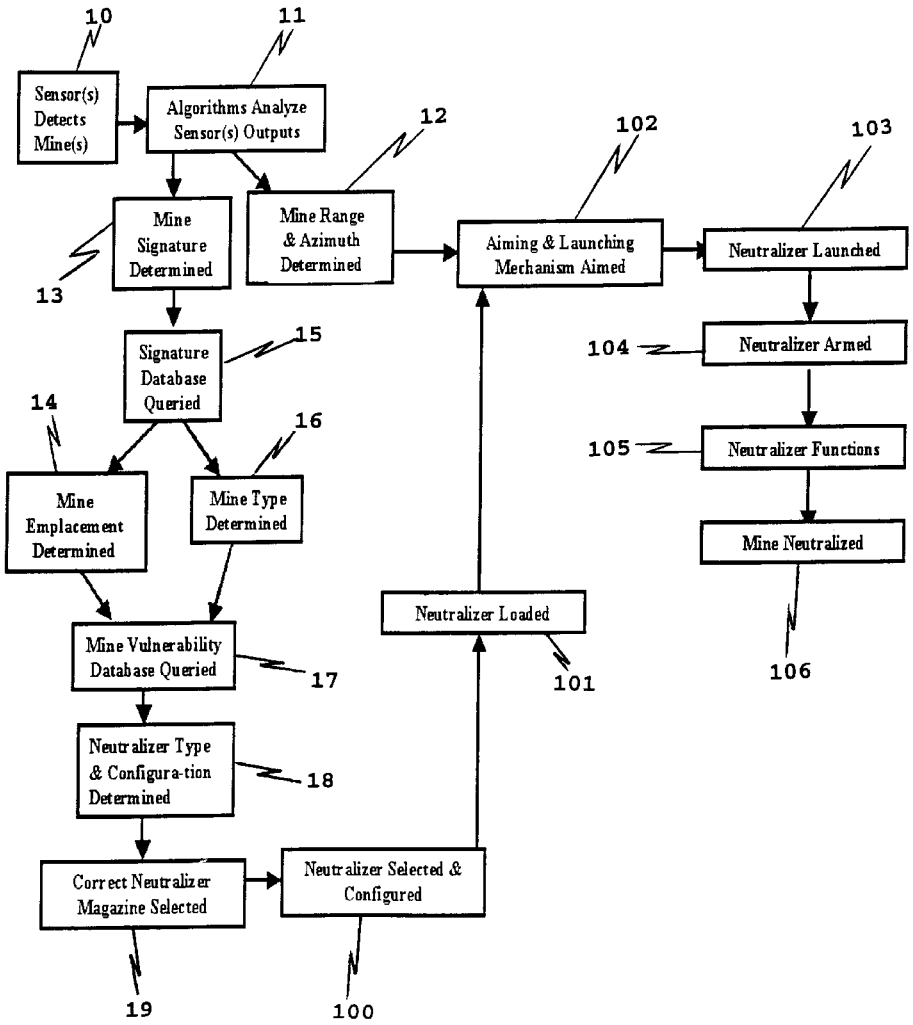

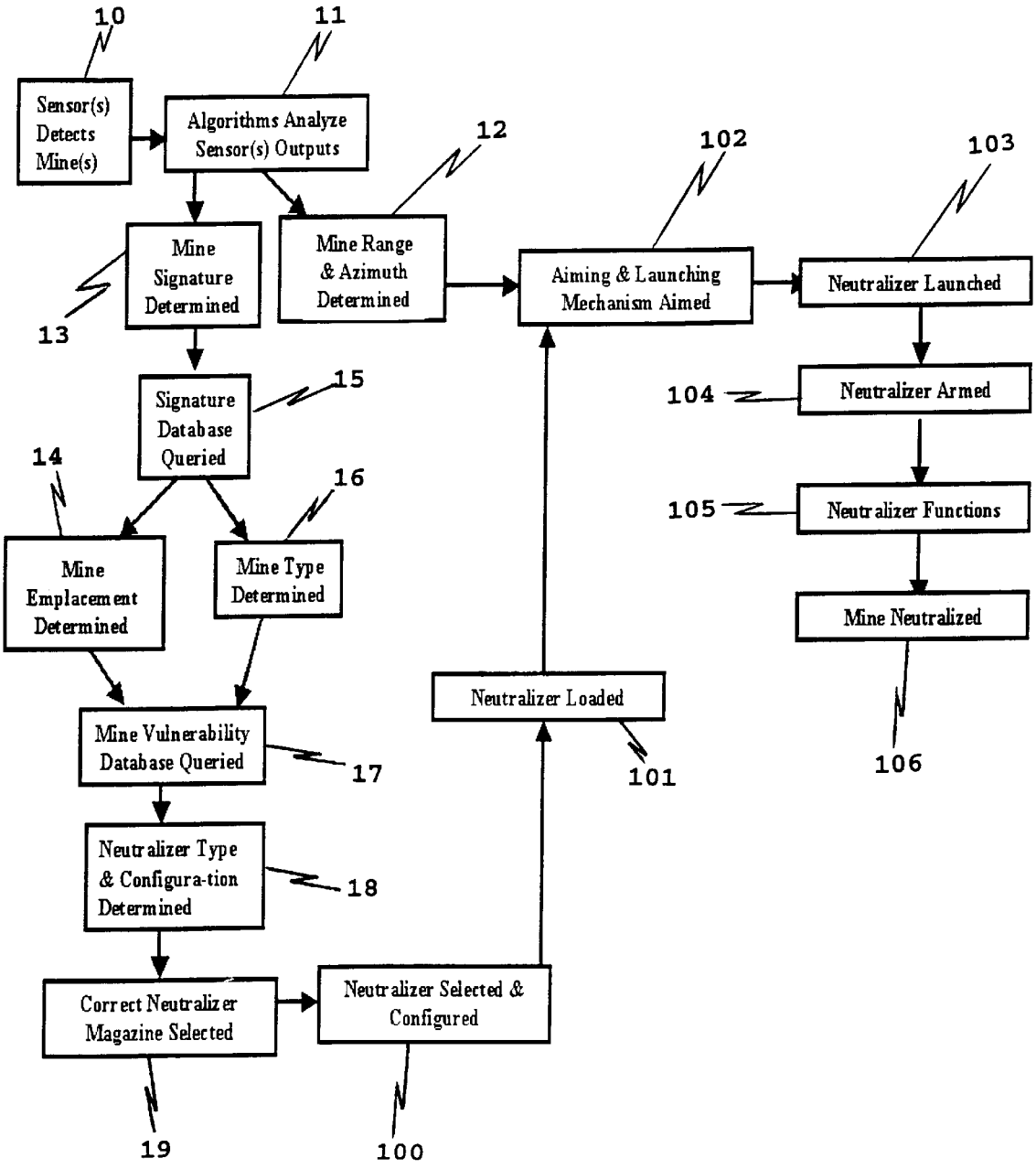
10
Sensor(s) Detects Mine(s)
11
Algorithms Analyze Sensor(s) Outputs
12
Mine Range & Azimuth Determined
13
Mine Signature Determined
15
Signature Database Queried
14
Mine Emplacement Determined
16
Mine Type Determined
Mine Vulnerability Database Queried
17
Neutralizer Type & Configura-tion Determined
18
Correct Neutralizer Magazine Selected
19
Neutralizer Selected & Configured
100
Neutralizer Loaded
101
102
Aiming & Launching Mechanism Aimed
103
Neutralizer Launched
104
Neutralizer Armed
105
Neutralizer Functions
Mine Neutralized
106

LAND MINE HUNTER KILLER TECHNIQUE

BACKGROUND OF THE INVENTION

1. Field of the Invention

The present invention generally relates to a technique for detecting and neutralizing explosives, and more specifically, to a technique for integrating detection (hunter) and neutralization (killer) of land mines by use of multiple sensor inputs with multiple neutralizer capabilities.

2. Description of Prior Art

Presently, detecting and neutralization of mines are separate functions each requiring separate personnel and equipment. Current detection equipment uses only one technology to detect mines. Current neutralization techniques (including mine breaching and mine clearing) require covering whole areas with large quantities of expendable neutralization assets. This requires tremendous logistical burden of men and materiel is very time consuming and places men and equipment in harms way. Once the presence of mines or a minefield is known, either breaching equipment is brought forward or soldiers using handheld detectors attempt to locate each individual mines that are to be neutralized.

The presence of mines or a minefield is usually determined by ground reconnaissance, captured documents or personnel, or from vehicles and personnel encountering the mine. Another method is for armored combat troops to use the Mine Roller to detect mines. Because of the limited number of mine blasts it can survive, it is used to detect the first mine or to proof a previously cleared lane. Once their presence is known, the only current capability to repeatedly detect mines is for soldiers using handheld detectors to enter the mined area and detect each mine individually. The detecting team both marks the location and proceeds with detecting the rest of the area or immediately falls back and the neutralizing team comes forward. The hazards of detecting mines are extremely great and the detecting team must proceed at a very, very slow pace.

For mounted soldiers, vehicle mounted breaching equipment is brought forward to deal with the threat. Current mounted capabilities for combat breaching include mechanical systems or explosive systems. The mechanical systems are all very slow, and systems such as plow and rake systems push earth and mines off to the side creating a cleared lane for combat vehicles to continue their advance. This leaves undetonated mines in the spoil on either side of the lane that must be dealt with at a later time. Being left in the spoil makes their subsequent detection and neutralization even more hazardous. For the dismounted soldiers, the only fielded combat breaching capability is the Bangalore Torpedo. Breaching is usually accomplished by a team of 8 soldiers carrying 1.5 meter long sections of explosive filled pipes forward to the edge of the mine field. At the edge of the minefield, two soldiers join and then push the sections into the minefield until the desired length is reached and then the device is detonated.

There are no current mounted mine clearing capabilities. For mine clearing, hand held mine detectors or probes are used to find the location of the mine neutralizing team manually probes the suspected area, finds the mine, uncovers it and blows it in place or disarms it, checks it for antihandling devices, and removes it. Current hand held detectors consists of electronic metal and nonmetallic detectors and handheld probes. Neutralization consists of bulk explosives placed in contact with or adjacent to the mine. Dismounted minefield breaching and mine clearing are both extremely hazardous and time consuming.

While the prior art has reported using separate and distinct mine detection, breaching and clearing techniques none have established a basis for a specific technique that is dedicated to the task of resolving the particular problem at hand. What is needed in this instance is a technique, capable of being mounted, for integrating the detection and neutralization of land mines that can be used for both mine breaching and mine clearing.

SUMMARY OF THE INVENTION

It is therefore one object of the invention to provide a technique, capable of being mounted, for integrating the detection and neutralization of land mines that can be used for both mine breaching and mine clearing.

According to the invention, a technique for integrating detection and neutralization of land mines is disclosed. A land mine is sensed with multiple sensors to output multiple sensor outputs. A mine signature is determined with corresponding range and azimuth which most closely correlates to said multiple sensor outputs. Mine type and mine emplacement which correlates to the mine signature is determined. A neutralizer type and configuration is detrmined which correlates to the mine type. A neutralizer type and configuration is selected along with a neutralizing magazine available for the neutralizer type and configuration. The neutralizer is selected, configured, and loaded. The aiming and launching mechanism of the neutralizer is aimed utilizing the corresponding range and azimuth. The neutralizer is launched and armed. The neutralizer functions whereby detection and neutralization of the mine is accomplished which can be used for both mine breaching and mine clearing. A signature database can be queried to determine mine type and mine emplacement that correlates to said mine signature. A mine vulnerability database can be queried to determine neutralizer type and configuration that correlates to said mine type.

BRIEF DESCRIPTION OF THE DRAWINGS

The foregoing and other objects, aspects and advantages will be better understood from the following detailed description of a preferred embodiment of the invention with reference to the drawings, in which:

The sole drawing figure is a flow diagram of the technique of the invention.

DETAILED DESCRIPTION OF A PREFERRED EMBODIMENT OF THE INVENTION

Referring now to the drawings, and more particularly to the sole drawing figure, there is shown a flow diagram of the technique of the invention. A sensor subsystem is activated that detects mines (10). The output of each sensor is individually analyzed, and the individual outputs are synergised into one combined output that can be further analyzed as final output 11. Synergizing the output of the detection sensors maximizes the probability of detection, to minimize false alarms (non-mine objects that look like mines), to minimize the uncertainty of the exact location (center) of the mine, to identify the type of mine, and to determine if the mine is on the surface or buried. The final output consists of the mine's range and azimuth 12, signature 13, and emplacement 14. The signature is then compared to signatures stored in its signature data base 15 to thus identify the mine 16. The range, azimuth, mine identification and emplacement data for each mine detected is sent to the mine neutralizer subsystem and that may be communicated as feedback for validation purposes.

The mine neutralizer subsystem uses the identification and emplacement data and searches its vulnerability data base 17 for each mine that was detected. The data base identifies the type neutralizer to use and, if required, it's optimum configuration to maximize the probability of neutralizing the mine 18. The correct neutralizer magazine (holding mechanism for multiple neutralizers) is thereby selected 19, correctly configured and selected 100, and loaded into the aiming and launching mechanism 101. The mechanism is aimed 102 and the neutralizer is launched 103. The sensor subsystem is informed when and what type of neutralizer was fired. The neutralizer arms itself 104 and, at the appropriate time, functions 105 and neutralizes 106 the mine. The neutralizer would fire one or more times to insure a high probability of killing the target.

The invention can be autonomous, semi-autonomous, or remotely controlled by an operator. If required, mission information is programmed into the invention and it is sent on its mission. The sensor subsystem consists of one or more sensors, computational capabilities, a mine signature data base, a mine neutralizer interface, and a communication interface. The mine neutralizing subsystem consists of one or more magazines loaded with mine neutralizers, a mine vulnerability data base, computational capabilities, and an aiming and launching mechanism.

The preferred embodiment of the invention consists of an unmanned, ground or airborne vehicle on which is mounted a sensor subsystem (Hunter) and a mine neutralizing subsystem (Killer). The hunter-killer system mounted on a ground vehicle of the perferred embodiment would be traveling down a road performing a route clearance mission. Its sensor sub system is scanning the road ahead of the vehicle analyzing all the signatures it detects against the signatures of mines in its database. Analysis of the combined data from the IR and ground penetrating radar sensors identifies one of the signatures as a TM-62M mine, 7 meters ahead of the vehicle. This is a pressure-fuzed Soviet antitank mine, 12 inches in diameter, with a metal casing and filled with TNT. A force of 380 to 1300 pounds is required to set off the mine. As it continues to approach the mine, the mine hunter killer uses this information along with the fact that it is on a route clearance mission to determine that the highest probability of neutralizing the mine is to use its overpass capability to drive over the mine and deposit a non-detonating neutralizer on top of the mine. Of the several neutralizers on board, it chooses a pyrophoric neutralizer. This neutralizer consists of a matrix of "flares" composed of solid rocket fuel material that burns at extremely high temperatures. As this is a large mine, the mine hunter killer expands the matrix to maximize the area of coverage and optimize the probability of neutralizing the mine. The matrix is deposited onto the mine, its delay fuze is armed and actuated, and the mine hunter killer proceeds on its mission. After the preset time the flares are ignited. They burn through the soil and the metal casing and ignite the TNT. The TNT then self sustains its total consumption. This process takes 10 to 15 minutes during which time the mine hunter killer proceeds down the road searching for more mines. This not only leaves the road intact but also speeds up the route clearance mission by allowing the mine hunter killer to continue on its mission while the mine is being neutralized behind it.

Sensors which may be utilized include, but are not limited to, downward-looking and forward-looking infrared (IR), charged couple devices, electromagnetic induction, ground penetrating radar, laser doppler vibrometer, acoustic rayleigh waves, biological or artificial chemical sniffers, nuclear quadrupole resonance, active and passive millimeter wave, thermal nuclear activation, and photon backscatter.

Potential neutralizers may include, but are not limited to, bulk explosives, explosively-formed projectiles or shape charges, hypergolic or pyrophoric chemicals, kinetic penetrators such as bullets or flechettes (with or without explosive warheads), high energy electromagnetic pulse devices, and high power microwaves. The bulk explosives, shape charges, chemicals and kinetic penetrators can be employed singularly or in a matrix. The interstitial spacing of the neutralizers within the matrix can be optimized to maximize the probability of neutralizing the mine.

The invention is useable for both combat breaching of minefields where time is of the essence (such as communication routes) or for mine clearance where 100% clearance is essential and time is not a factor. Combining detection and neutralization equipment into one platform reduces the quantity of equipment and the number of personnel required. By detecting individual mines rather than clearing 100% of an area, the quantity of consumables is tremendously reduced. Achieving these functions at a standoff greatly increases the survivability of both equipment and personnel.

While this invention has been described in terms of preferred embodiment consisting of separate hunter and killer techniques, those skilled in the art will recognize that the invention can be practiced with modification within the spirit and scope of the appended claims.

Having thus described my invention, what I claim as new and desire to secure by Letters Patent is as follows:

1. A technique for integrating detection and neutralization of land mines comprising the steps of:

sensing a land mine with multiple sensors to output multiple sensor outputs;

determining at least one mine signature with corresponding range and azimuth which most closely correlates to said multiple sensor outputs;

determining mine type and mine emplacement which correlates to said mine signature;

determining neutralizer type and configuration which correlates to said mine type;

selecting a neutralizer type and configuration;

selecting a neutralizing magazine available for said neutralizer type and configuration selected;

selecting and configuring a neutralizer;

loading said neutralizer;

aiming an aiming and launching mechanism of said neutralizer utilizing said corresponding range and azimuth;

launching said neutralizer;

arming said neutralizer;

activating said neutralizer whereby detection and neutralization of said mine is accomplished which can be used for both mine breaching and mine clearing.

2. The technique of claim 1 wherein the steps further include querying a signature database to determine mine type and mine emplacement that correlates to said mine signature.

3. The technique of claim 1 wherein the steps further include querying a mine vulnerability database to determine neutralizer type and configuration that correlates to said mine type.

* * * * *